United States Patent [19]

Grontoft

[11] 4,155,821

[45] May 22, 1979

[54] ELECTROWINNING METAL FROM CHLORIDE SOLUTION

[75] Inventor: Fridtjov Grontoft, Kristiansand, Norway

[73] Assignee: Falconbridge Nickel Mines Limited

[21] Appl. No.: 847,110

[22] Filed: Oct. 31, 1977

Related U.S. Application Data

[63] Continuation-in-part of Ser. No. 760,844, Jan. 21, 1977, which is a continuation of Ser. No. 632,566, Nov. 17, 1975, abandoned.

[30] Foreign Application Priority Data

Nov. 25, 1974 [GB] United Kingdom ..... 50892/74

[51] Int. Cl.[2] ..... C25C 1/08; C25B 1/26

[52] U.S. Cl. ..... 204/113; 204/128

[58] Field of Search ..... 204/113, 128

[56] References Cited

U.S. PATENT DOCUMENTS

| | | | |
|---|---|---|---|
| 1,371,698 | 3/1921 | Linder | 204/263 |
| 3,959,111 | 5/1976 | Mardine et al. | 204/258 |

FOREIGN PATENT DOCUMENTS

| | | | |
|---|---|---|---|
| 283596 | 12/1927 | Fed. Rep. of Germany | 204/113 |
| 44-23747 | 8/1969 | Japan | 204/113 |

OTHER PUBLICATIONS

"A Study of Impurities in Co. Electrowinning" by Churchward et al., E.C.S. Preprint 85-10, 4-17-44, pp. 101-103, 115-117.

*Primary Examiner*—R. L. Andrews
*Attorney, Agent, or Firm*—Bacon & Thomas

[57] ABSTRACT

A method for electrowinning metal from metal chloride-bearing electrolyte in an electrolytic cell wherein diffusion of chlorine from anolyte to catholyte is limited, thereby limiting concentration of chlorine gas around the cell so as to be within acceptable limits. Catholyte is withdrawn through a catholyte overflow duct in the cell to establish a catholyte level and the anode is maintained in an electrolyte-permeable diaphragm which is attached to a hood extending above the electrolyte level. Chlorine gas generated at the anode is withdrawn from the hood by applying suction via a suction duct located in the hood above the catholyte level and electrolyte is drawn through the diaphragm into the anolyte and upwardly inside the hood. Anolyte is withdrawn therefrom under the suction as an overflow via an anolyte outlet duct in the hood above the catholyte level.

5 Claims, 3 Drawing Figures

ELECTROWINNING METAL FROM CHLORIDE SOLUTION

This is a continuation-in-part of application Ser. No. 760,844, dated Jan. 21, 1977 which itself is a continuation of application No. 632,566, dated Nov. 17, 1975, now abandoned.

This invention relates broadly to the electrolytic generation of electrolyte-soluble gases, notably chlorine, more particularly to electrowinning from metal chloride-bearing solutions in diaphragm cells, and specifically to means for limiting the evolution of anodically-generated chlorine to the atmosphere surrounding the cell, and for controlling the operation of a multiplicity of such cells in a tankhouse.

In processes for the electrolytic production of metals on a commercial scale, the use of electrolytic cells containing electrolyte open to the surrounding atmosphere in the tankhouse for the convenient insertion and withdrawal of cathodes is a well recognized advantage, if not a necessity, with respect to both the practicability and the economics of the operation. It is equally clear, however, that gases generated in such cells will freely enter the tankhouse atmosphere unless means are provided to limit such entry. While the application of such means might be neither necessary nor advantageous under some circumstances, it is clearly essential if the gas is either explosive, toxic, or otherwise hazardous, as is the case with chlorine.

In the electrolytic chlorine industry, the containment and isolation of chlorine from the tankhouse atmosphere is readily effected by sealing the cells completely, a convenient and tolerable remedy in such cells, because there is no greater requirement for removal and replacement of the cathodes than for that of the anodes. Such means are clearly irrelevant, however, for handling chlorine generated anodically when electrowinning metals from chloride solutions, because the cells must be open for the regular changing of cathodes. Under this condition, the chlorine must be confined at the anodes and isolated from the surrounding atmosphere.

Due to the significant solubility of chlorine in aqueous solutions, an additional problem that can arise in electrowinning from chloride solutions is the presence or undesirable concentrations of dissolved chlorine in the electrolyte around the cathode, not only because such chlorine is subject to reduction at the cathodes, thereby decreasing the current efficiency of the process, but also because electrolyte around the cathodes is open to the tankhouse atmosphere and chlorine can therefore escape from the electrolyte into the tankhouse and create a health hazard unless means are provided to prevent it.

This problem can be overcome by surrounding the anode with an electrolyte permeable diaphragm and causing electrolyte to flow in the cell from the catholyte through the diaphragm into the anolyte, as discussed in French Pat. No. 2,074,572. It is pointed out that a small suction hood allows the collection of gases evolved at the anode, but beyond this no information is given in this patent regarding means to withdraw either anolyte or chlorine gas from the vicinity of the anode or to control electrolyte flow to or from the cell.

U.S. Pat. No. 3,959,111 describes a cell for use in electrowinning metal from chloride solutions and while it refers to means for removal of chlorine from the vicinity of the anode there is no provision for removal of anolyte. The anode is surrounded by a diaphragm and superposed by a hood that extends below the surface of the electrolyte thereby enclosing a space above the anode in which chlorine collects and from which it is removed under suction. The drawings and description further provide, however, that the electrolyte level is the same both inside and outside the diaphragm, thereby precluding bulk flow of electrolyte across the diaphragm but not the undesirable diffusion of dissolved chlorine from the anolyte to the catholyte. That such diffusion probably occurs is suggested by drawings and description of complex means to remove vapors from the electrolyte surface outside the hoods, which means include blowing air into the cell below each cathode, covering the cell with overlapping rubber strips attached to anode supports above the hoods, providing closely spaced rods between the rubber covering and the top edges of the cell, applying suction to sweep the electrolyte surface with air drawn in between the rods from the surrounding tankhouse atmosphere and withdrawing the resulting gases under the action of the applied suction. The arrangement appears not only cumbersome in design and awkward in use but results in dilution of the vapors with air and consequent additional expense whether they are discarded or recovered for recycle. It is also significant to point out that there is only one overflow for electrolyte from this cell, a feature that is characteristic of the prior art. There is no provision in this or other cells, of which I am aware, for the separate overflow of both anolyte and catholyte.

Japanese Utility Model Publication No. 51(1976)-22885, dated June 12, 1976, describes an anode arrangement for use in electrowinning from chloride solutions, but the arrangement has disadvantages for use on a commercial scale. The anode is surrounded by a diaphragm and closed at the top by a hood with two outlet ducts, one above the electrolyte surface in the cell presumably for removal of chlorine gas, and the other below the electrolyte surface apparently for removal of anolyte. The arrangement suggests that chlorine flows out of the hood under its own pressure and that anolyte flows out freely under gravity at a level below that of the catholyte without positive control or restriction and that the anolyte flow is therefore limited only by the permeability of the diaphragm and the size of the outlet duct.

It is also significant to point out, in passing, that a further apparent disadvantage of the Japanese invention is that the anolyte outlet duct must protrude through the wall of the cell below the catholyte level and therefore be sealed in watertight relationship through the wall, an awkward, costly and potentially troublesome arrangement that is also overcome by the present invention.

French Pat. No. 465,128 describes a caustic-chlorine cell in which the cathode is bagged and hooded and hydrogen generated at the cathode is utilized to lift catholyte as a froth away from the cathode thereby causing a replacement flow of electrolyte through the bag from the anolyte outside it and limiting the concentration of caustic in the catholyte. The flow of catholyte so generated, however, is dependent on the electrolytic generation of hydrogen and no means are taught to increase or control the electrolyte flow independent of the hydrogen flow. Application of the teachings of this patent to the use of chlorine to lift anolyte as froth away from the anode of a metal chloride electrowinning cell would be hazardous and unacceptable because of the high solubility and toxicity of chlorine and the consequent necessity for means to increase and control the flow of anolyte sufficiently to prevent intolerable back-diffusion of dissolved chlorine through the anode diaphragm into the catholyte and evolution therefrom into the tankhouse atmosphere. Such necessity is not even recognized much less satisfied by the teachings of this French patent.

German Pat. No. 283,596 is a modification and extension of the invention described in French Pat. Nos. 465,128, and describes the application of suction to raise the catholyte level inside the hood toward but below an overflow and thereby assist the hydrogen in the froth transport of the catholyte the remainder of the height to the overflow. Sustained flow of catholyte is still dependent entirely on the hydrogen, however, and is nonexistent under the action of the suction alone in the absence of hydrogen. Thus this German patent suffers from similar weaknesses and shortcomings as French Pat. No. 465,128 is dealing with the problems overcome by the present invention.

In a commercial electrolytic tankhouse containing many cells, each with many anodes and cathodes, it will be appreciated by those familiar with the art, that the collection of gases and electrolyte from each cell for centralized treatment and process recycling are both significant problems. Due to the pressure drop in gas lines, for example, suction must be applied to prevent leakage of gas into the tankhouse at electrodes covered by hoods, that might otherwise occur if gas pressure were permitted to increase to the point that the gas could flow in the lines in the absence of suction. Furthermore, in the absence of means to limit the volume of electrolyte that must be pumped, processed and recycled, the cost of operating the process could be prohibitive. Neither of these problems has been faced by existing methods and apparatus described for electrowinning from chloride-bearing solutions, and it is these shortcomings of the prior art to which the present invention is primarily directed and which are thereby advantageously overcome.

A desirable feature of any tankhouse operation, as of any process in general, is uniformity of conditions. In a tankhouse for the electrowinning of metal from chloride solutions it is desirable that the cells are all of uniform size and shape and that each cell have the same number of uniform anodes and cathodes and the same current flow, chlorine generation and metal production. Under these conditions it is equally desirable that the electrolyte flow through each cell be the same as well so that metal depletion and changes in pH, specific gravity and other electrolyte characteristics are substantially the same in each cell. One factor over which the operator has little if any control, however, and which varies not only from cell to cell but from anode to anode in a given cell, is the permeability of the anode diaphragm, which clearly results in corresponding variations in electrolyte flow through the diaphragms. It is to the provision of improved means for ensuring uniform electrolyte flow through each cell in the face of variable electrolyte flow through each diaphragm that this invention is also particularly directed.

The present invention relates to a method for electrowinning metal from an aqueous chloride electrolyte in a cell open to the atmosphere around it and containing a multiplicity of alternating anodes and cathodes by electrolyzing the electrolyte thereby generating metal at the cathodes and catholyte around them, generating chlorine at the anodes and anolyte around them, and dissolving a portion of the chlorine in the anolyte, and the improvement comprising, (i) surrounding each anode by an electrolyte-permeable diaphragm bag thereby providing a boundary between anolyte inside the bag and catholyte outside it, (ii) securing each bag to an anode hood extending upwardly from below the surface of the electrolyte and equipped with an outlet therefrom above the top of the cell for overflow of anolyte, (iii) providing an outlet from the cell below the top thereof for overflow of catholyte, (iv) applying suction to the anode hoods to withdraw chlorine therefrom and generate a first flow of electrolyte in the cell directed into the bags, upwardly inside the hoods and through the outlets therefrom as a multiplicity of anolyte overflows thereby inhibiting back-diffusion of dissolved chlorine out of the bags onto the catholyte and escape therefrom into the atmosphere around the cell, and (v) simultaneously feeding fresh elecrolyte to the catholyte at a rate in excess of total anolyte overflow rate to generate a second flow of electrolyte in the cell directed through the outlet from the cell as catholyte overflow, thereby establishing a catholyte level in the cell and dividing electrolyte flow in the cell into both anolyte and catholyte overflows so that total anolyte overflow rate can change with adjustments to applied suction and differences in diaphragm permeabilities while at the same time electrolyte feed rate to the cell can be held constant for a constant cell current thereby advantageously effecting constant metal depletion from the electrolyte in the cell as electrowinning proceeds.

The features and advantages of this invention will be more clearly understood by reference to the following drawings.

Figure 2:
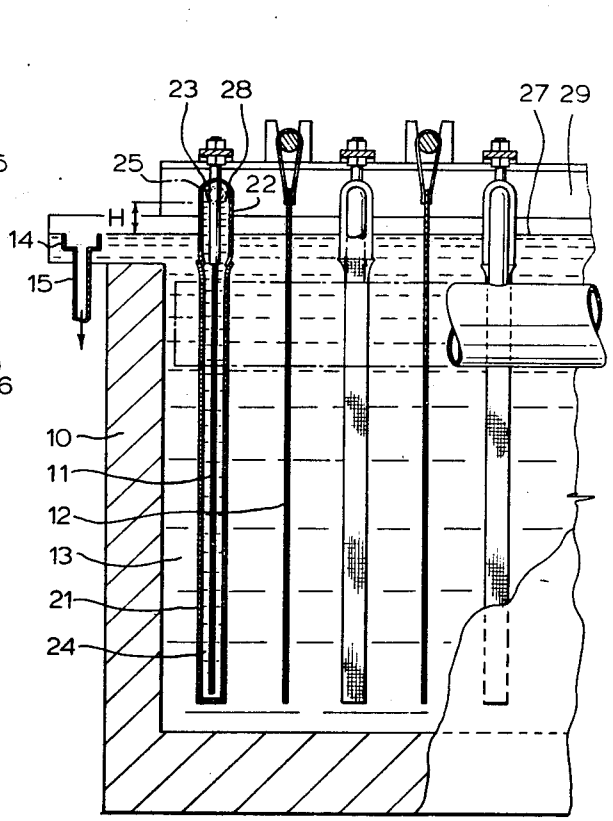
FIG. 2 is a schematic side view of the cell of FIG. 1 showing an electrolyte overflow arrangement and alternating anodes and cathodes as in a commercial cell.
Figure 1:
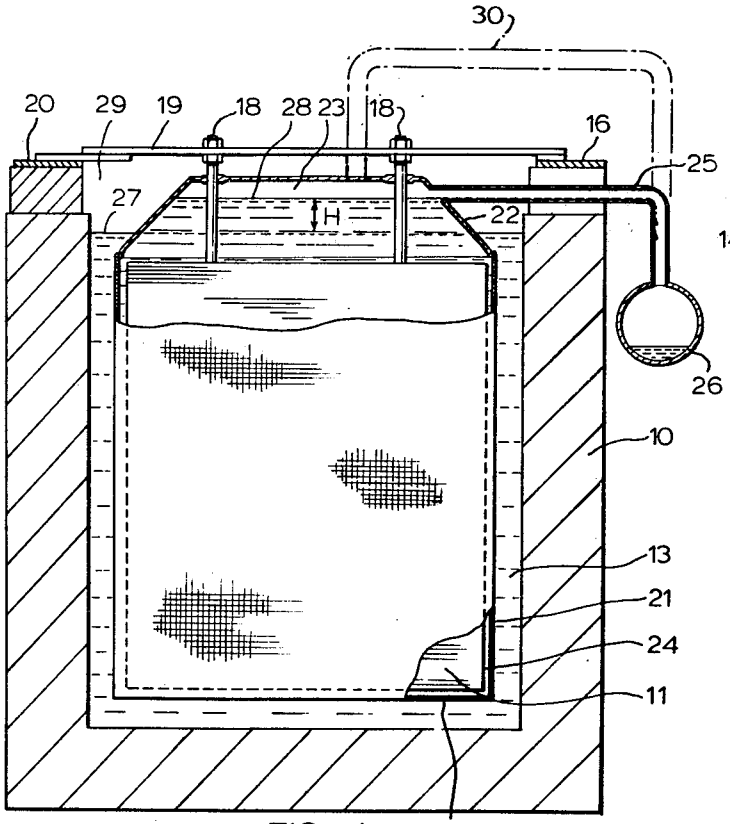
FIG. 1 is a schematic end-view of an electrolytic cell with an anode arrangement contained therein according to the present invention.

Referring first to FIGS. 1 and 2 of the drawing, the present invention is carried out in an electrolytic cell 10 containing an anode 11, a cathode 12, and a body of metal chloride-bearing electrolyte 13. The cell is additionally equipped with an electrolyte overflow duct arrangement comprising advantageously, although not essentially, a variable height weir 14, vertically moveable on an overflow duct 15. The anode 11 is insoluble and can be either metallic, such as titanium coated with a noble metal-bearing material, for example, or nonmetallic, such as graphite. Conductive leads 18 are attached to the anode and extend above the cell to a conductive support bar 19, one end of which is in electrical contact with a busbar 20 and the other end of which is insulated from a busbar 16. The anode is surrounded by an electrolyte-permeable diaphragm 21, which completely encloses tge bottom of the anode and is attached at its upper end to a hood 22, which extends upwardly from below the surface of the electrolyte 13 to enclose a freeboard space 23 above enclosed electrolyte 24 surrounding the anode. An outlet duct 25 is situated in the hood above the surface of the electrolyte 13, and this outlet duct is conveniently and advantageously an overflow duct as shown, which extends over the top edge of the cell and opens into a manifold 26. The hood is sealed in gastight relationship to the anode leads and the whole assembly of hood, outlet duct and manifold is suitable for containing and directing the flow of chlorine gas and enclosed electrolyte from the anode, as described in more detail below. For the sake of brevity and clarity, the enclosed electrolyte 24 surrounding the anode inside the diaphragm is hereinafter referred to also as anolyte. For convenience, the electrolyte 13, which is outside the diaphragm and exposed to the atmosphere surrounding the cell, is also referred to simply as catholyte and the anode diaphragm 21 is also referred to as the anode bag.

Having referred to the basic apparatus elements of the present invention, the improved electrowinning process carried out in this apparatus will be more clearly understood by further reference to FIGS. 1 and 2 and the following additional description. It is convenient to assume at the outset that the cell is full of electrolyte to the level of the variable height catholyte overflow duct or weir 14, thereby establishing an electrolyte or catholyte level 27, and that current is flowing in the cell, thereby electrowinning metal at the cathode 12 and generating chlorine gas at the anode 11. Some of the chlorine dissolves in the anolyte 24 but the majority rises into the hood 22 from which it must be removed. Such removal is readily effected by applying suction in the manifold 26 and in addition to drawing off chlorine the suction has a further effect that is central to the present invention. Thus the suction causes flow of electrolyte to be drawn from the catholyte through the diaphragm into the anolyte and upwardly inside the hood 22 and, in a cell with only one anode, the suction that is applied is adjusted to be at least sufficient to cause the anolyte surface inside the hood to rise to a level 28 at which anolyte can over-flow freely from the hood under gravity through the outlet duct 25. Such overflow of anolyte from the hood is essential to limit back-diffusion of dissolved chlorine through the diaphragm from the anolyte into the catholyte and thereby to limit in turn the escape of chlorine from the catholyte into the atmosphere surrounding the cell. The suction required to cause anolyte overflow from the hood is a direct function of the height difference, H, between the anolyte overflow level 28 and the catholyte level 27 and for a given suction the magnitude of the anolyte overflow varies inversely with H. Since the position of the outlet duct 25, and consequently the anolyte overflow level 28, are fixed in space when the anode is in place in the cell, H is adjustable by changing the vertical position of the variable height weir 14, thereby changing the catholyte level 27. Maintaining of the catholyte level is conveniently ensured by feed 29 of electrolyte into the cell at a rate in excess of that at which anolyte overflows from the hood, thereby maintaining an electrolyte overflow from the cell at weir 14 through the overflow duct 15 and consequently ensuring a fixed catholyte level for a given position on the weir.

Since anolyte overflow must be handled and treated to remove dissolved chlorine before returning the electrolyte to the cell, it is clearly desirable that the amount of such overflow be the least that is consistent with providing the flow of electrolyte through the diaphragm necessary to adequately limit the escape of chlorine from the catholyte to the surrounding atmosphere as referred to earlier. Thus for a given suction applied for removal of chlorine and anolyte from the hood, the level of the variable height weir 14 is preferably adjusted to establish the maximum height difference H that is consistent with the minimum required anolyte overflow referred to above.

Figure 3:
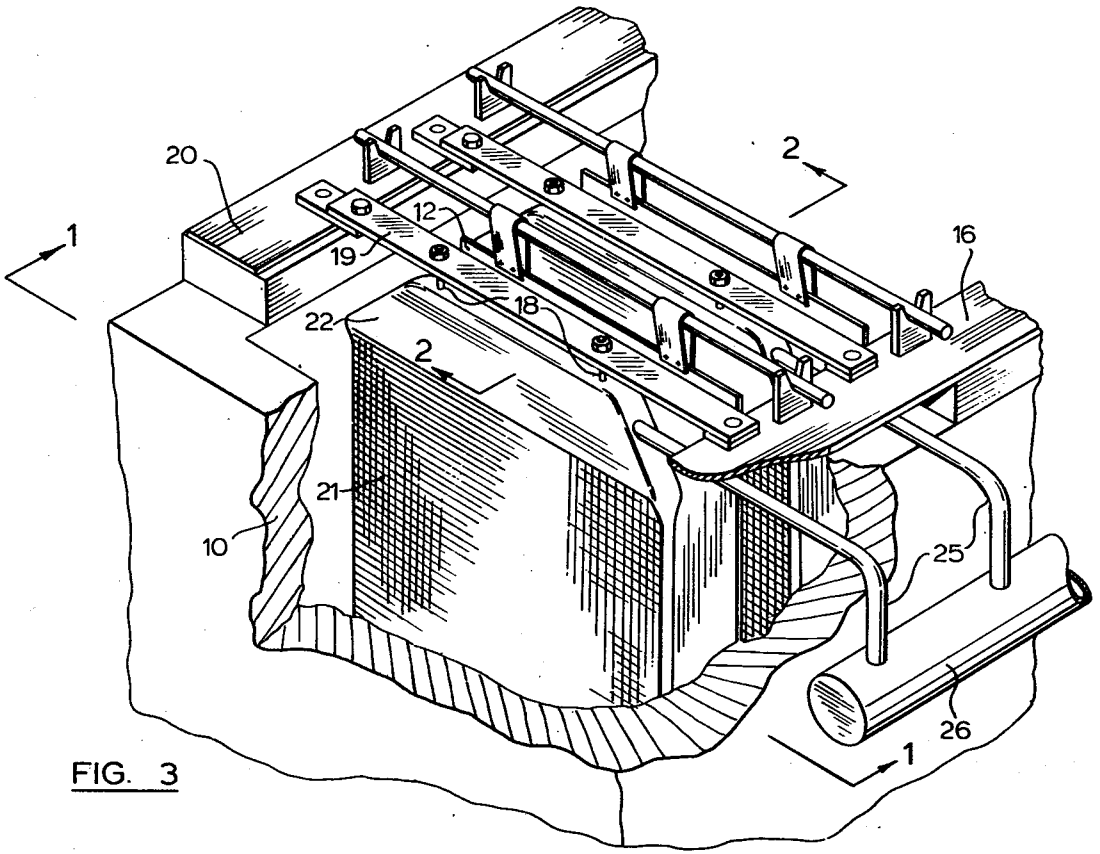
FIG. 3 is a schematic isometric view of the cell of FIGS. 1 and 2.

The above statements apply directly to a cell with a single anode and would similarly apply to a cell with a multiplicity of anodes provided the value of H for all the anodes was the same, as ideally indicated in FIG. 2. In commercial practice, however, because of the individual construction and suspension of each anode, it is likely that the value of H for one anode will differ from that of others in the same cell and thus the anolyte overflow from one anode under a given applied suction will differ from that of its neighbours under the same applied suction. The resulting consequences can be more clearly described by reference to FIG. 3 showing an isometric sketch of the cell of FIGS. 1 and 2 containing a multiplicity of alternating anodes and cathodes characteristic of a commercial cell. The outlet duct 25 from the hood of each anode is conveniently attached to the common manifold 26 running along one side of the cell. The manifold is advantageously sized so that each outlet duct is under substantially the same suction. If the suction were just sufficient to cause anolyte to overflow through the outlet duct of the anode with the least value of H, then it follows that less or no anolyte would overflow through the others and the resulting chlorine concentration in the tankhouse atmosphere could well be above safe limits. If, on the other hand, the suction were sufficient to cause anolyte to overflow through the outlet duct of the anode with the greatest value of H, then more anolyte would overflow through the others and the total resulting anolyte overflow could well be greater than that necessary to keep the chlorine concentration in the surrounding atmosphere within safe limits.

Optimum operation therefore results when the suction is adjusted and controlled at the minimum consistent with the minimum necessary total anolyte overflow, but caution should be exercised in approaching this condition. It is prudent to apply sufficient suction initially to cause anolyte overflow from all the outlet ducts in the cell and then to decrease the suction in small increments while monitoring the effect of each decrease in turn. In this manner optimum operation can be approach gradually without danger to operating personnel.

While suction is the practical operating control parameter, the variable having the most fundamental or direct effect on the diffusion of dissolved chlorine through the diaphragm from anolyte to catholyte is presumably the velocity of electrolyte flow through the diaphragm in the opposite direction under the action of the applied suction. The greater this velocity the less the back-diffusion of chlorine but while it is presumably possible to establish the relationship between the two for a given electrolyte composition, temperature and other conditions, velocity is not a useful control parameter in practice because it is not itself a constant in a given cell under a constant suction. Pressure drop across an anode diaphragm increases with depth below the electrolyte level thereby reflecting a corresponding variation in velocity with depth for a given diaphragm. In addition, the difference in anolyte overflow from one anode to another resulting from a difference in their H values, as referred to earlier, also reflects a corresponding difference in velocity of electrolyte across the respective anode diaphragms at a given depth below the electrolyte level. Evidence of the increasing flows and velocities of electrolyte through an anode diaphragm with increasing depth is emphatically provided by a simple pair of tests made to determine the effect of "half" and "whole" double diaphragms on the anolyte overflow from a given anode at constant suction.

Initially the anode was surrounded by a single layer of diaphragm material and the anolyte overflow was measured. In one test a second layer of the same diaphragm material was placed inside the bottom half only of the original diaphragm and the anolyte overflow decreased to about 60% of the initial value.

In the other test the diaphragm was a complete double layer, again of the same material, but the anolyte flow was the same, within measuring error, as with the half double diaphragm. It is evident, therefore, that substantially all the electrolyte flow occurred through the lower half of the diaphragm, and with substantially no flow through the upper half of the diaphragm, back-diffusion of chlorine might well have occurred.

There is ample evidence that such back-diffusion does occur in practice and is perfectly acceptable provided it is held within tolerable limits. Thus in cells operating satisfactorily according to the practice of this invention for the electrowinning of nickel from nickel chloride-bearing electrolytes, chlorine concentration in the catholyte has been found commonly to be 3 mg/liter without any smell of chlorine in the surrounding atmosphere and higher concentrations are tolerable, as shown in Example 3 below. It is not uncommon that the diaphragm around one or more anodes with the lowest anolyte overflows for a given cell actually bulges away from the anode near the surface of the electrolyte thereby indicating bulk flow of chlorine-bearing anolyte out of the anode bag at its upper end while electrolyte is flowing into the bag lower down.

Because the electrolyte velocity through the anode diaphragms of a given cell under a given suction is not a constant it is convenient to view all the diaphragms in the cell as one and to consider that electrolyte flows through the diaphragm at some mean velocity under a given applied suction. In practice the mean velocity must be at least the required minimum for adequate limitation of chlorine back-diffusion and this condition is demonstrably met when the suction is high enough that the chlorine concentration in the surrounding atmosphere is within safe limits.

Apart from the fact that the required suction is not an absolute quantity and must be determined for each cell in turn, the difficulty of quantifying it is complicated by the uncertain magnitude of the variables comprising it, as discussed below with reference to the following expression:

$$S = H\delta + D.F. + P.D.$$

where S is the total applied suction in mm water gauge (w.g.) measured at a given point in the gas handling system, H is the height difference in mm defined earlier and shown in FIGS. 1 and 2, $\delta$ is the effective specific gravity of the mixture of anolyte nd chlorine bubbles in the anode hood, D.F. is the "driving force" in mm w.g. necessary to cause the anolyte overflow required for safe operation, P.D. is the "pressure drop" in mm w.g. in the gas handling system between the anode hoods and the point where the suction is set and measured.

The first term, $H\delta$, is the suction required to raise anolyte to the outlet duct before it can overflow. Both factors comprising the term are variables. Not only can the nominal value of H be selected at will, generally in the satisfaction of engineering convenience, but in addition, the actual values of H for different anodes generally cover a range of unspecified breadth around the nominal value. Thus in one case the nominal H might be 45 mm, say, with actual values ranging from perhaps 37 to 52 mm, while in another case the nominal H might be 60 mm with a range from 56 to 63 mm.

The value of 67 is variable and uncertain because it depends not only on the specific gravity of the electrolyte itself but also on the relative volumes of anolyte and chlorine bubbles in the hood, both of which are variables and not readily determined. While all that can be said with confidence about $\delta$ is that it must be less than that of the electrolyte alone, the appearance of froth in the hoods in some cases suggests that the effective $\delta$ is significantly less than that of electrolyte alone. Froth is particularly noticeable with plate or grid-type anodes, presumably because the flow of electrolyte into the anode bag presses it against the anode thereby significantly decreasing the effective anolyte volume. In any case the suction required to lift the anolyte to the outlet in a given hood could vary widely from more to less than the H value itself and can therefore be determined for a given anode only by experimentation.

The second term, D.F., is the portion of the suction that controls the amount of anolyte overflow, and since $H\delta$ is not constant from one anode to another, neither is D.F., nor, in consequence, is the anolyte overflow. The total anolyte overflow from all the anodes in the cell must satisfy the mean velocity condition described earlier but the necessary overflow is a function not only of the distribution of H values in the cell, as already discussed, but also, notably, of the permeability of the diaphragm material. The less permeable the diaphragm the less the anolyte overflow for a given suction, as shown in the tests described above with double diaphragms. As permeability is decreased it might be possible to decrease the driving force as well and still satisfy the necessary mean velocity condition.

The third term in the expression, P.D., refers to the pressure drop between the anode hood and the point in the gas handling system where total suction is actually set and measured. In commercial practice it is convenient that suction be controlled at a point remote from any one cell so that several cells can be connected in parallel under the same total applied suction. In such an arrangement the suction at each cell is less than that at the remote control point by the amount of the pressure drop between it and the cell.

The ultimate condition that must be satisfied in the practice of this invention is that the chlorine concentration in the atmosphere surrounding the cell be within acceptable safe limits for human health. These limits may be known quantitatively in advance, generally by government decree, but not so the suction required to satisfy them. The suction can only be defined qualitatively in advance because it depends quantitatively on many variables as discussed above.

Referring again to FIG. 1, it can be appreciated that with suction applied in the manifold 26 the outlet duct 25 becomes also the suction duct through which chlorine gas passes along with any overflow anolyte. It is pointed out, however, that the chlorine and anolyte do not have to leave the anode hood through the same outlet duct 25. Such an arrangement is convenient but a separate suction duct connected to the suction system can be provided above duct 25, as suggested by the dotted lines 30. In such an alternative arrangement anolyte would overflow through the lower outlet duct 25 and chlorine through the upper suction duct 30 but otherwise the system would function as already described.

Anolyte overflow can vary not only from anode to anode in a given cell, as described in the foregoing discussion, but also from cell to cell in the tankhouse. As mentioned earlier, however, it is desirable in the operation of any commercial tankhouse with many cells that both the design features and the operating conditions for all the cells be as uniform as possible. Such uniformity is particularly desirable with respect to electrolyte characteristics such as composition, acidity and pH, which affect the quality of the electrodeposited metal and thus it is important that metal depletion of the electrolyte in the cells resulting from the electrowinning operation be controlled, preferably to a constant and uniform extent in each cell. Depletion is uniform and constant if fresh electrolyte of constant composition is fed to each cell at a constant rate relative to a constant cell current. Means must of course be provided to remove electrolyte from the cells as feeding occurs and it is such removal means to provide both for constant electrolyte feed to each cell and also at the same time for variable anolyte overflow from each cell that is another essential and distinguishing feature of this invention.

Thus according to the present invention such removal means are conveniently and advantageously provided by ensuring the presence of both anolyte and catholyte overflow means for each cell. By this means fresh electrolyte can be fed to each cell at a steady rate while anolyte overflow can vary from cell to cell or from time to time in a given cell and the difference between electrolyte feed and anolyte overflow, whatever it is, however big or small, simply leaves the cell as catholyte overflow through the catholyte overflow duct already described.

The catholyte overflow in the present case therefore serves two distinct functions; it provides a catholyte level in the cell as a datum against which suction can be adjusted for the control of anolyte overflow, as described in detail above, and it allows for fresh electrolyte to be fed to the cells at a steady rate, in response to the desirability for constant depletion, and at the same time allows anolyte overflows to be adjusted to various lesser rates, in response to the requirement for limiting back-diffusion of dissolved chlorine through the bags into the catholyte, as described earlier. The only condition that must be met in this regard is, as indicated above, that the feed rate of fresh electrolyte must exceed the anolyte overflow rate to ensure that there is a catholyte overflow from all cells as electrowinning occurs.

In a tankhouse with many similar cells and a similar current flowing through each cell, the feed rate of fresh electrolyte, according to a preferred practice of the present invention, is substantially the same to each cell and also greater than the anolyte overflow rate from any one of the cells. Under these conditions anolyte overflow rate can vary widely from cell to cell throughout the tankhouse while electrolyte characteristics advantageously remain substantially uniform.

The anolyte and catholyte overflows are conveniently, although not essentially, replenished with make-up metal chloride and recycled to the cells as fresh electrolyte, thereby closing an electrolyte recirculation system. In such a system the anolyte must first be dechlorinated so that the fresh electrolyte feed to the cells remains substantially free of dissolved chlorine. Such dechlorination is effected by conventional known means and the chlorine can be conveniently utilized to generate the make-up metal chloride. It should be understood, however, that the invention does not depend on such an electrolyte recirculation system for a supply of fresh electrolyte. The anolyte and catholyte overflows could be used for other purposes, as could chlorine recovered from the anolyte, and fresh electrolyte could be generated from fresh materials without the use of recirculated solutions. In short, a supply of fresh electrolyte is essential but the means of its generation is not.

Basically the invention is characterized by two essential components:

(i) The provision of means, as described herein, for the application and control of suction to limit back-diffusion of dissolved chlorine into the catholyte, and (ii) The provision of both anolyte and catholyte overflow means in each cell, as described herein, so that anolyte overflow rate can be varied as required to limit back-diffusion of dissolved chlorine while fresh electrolyte feed rate is held at a higher but steady value, relative to cell current, to keep depletion and other electrolyte characteristics correspondingly steady.

Having described the essential, important and advantageous elements of the present invention in general terms, the application of the invention to the electrowinning of both nickel and cobalt is illustrated by the following examples.

EXAMPLE 1

A cell for the electrowinning of nickel from a chloride-bearing electrolyte was set up basically according to the arrangement shown in FIGS. 1, 2 and 3. The cell contained 36 nickel cathodes, each between two of 37 graphite anodes. The average electrode spacing from cathode centre to anode surface was about 75 mm. The anode diaphragms were made of tightly woven cloth of artificial fibre, the anode hoods of thermosetting plastic sealed to the graphite and the diaphragms were attached to the hoods below the catholyte level.

The electrolyte feed was supplied to the cell at a rate of 1.5 $m^3$/hr, a pH of 2.4 and a temperature of 62° C., with the following composition in g/l:

| Ni | Cl | $SO_4$ | $H_3BO_3$ | Na |
|---|---|---|---|---|
| 67.- | 88.- | 50.3 | 15.- | 28.- |

Current was supplied at 8.9KA, a cathode current density of 172 A/$m^2$, and a potential of 3V. Current efficiency was 98.5% and nickel production from the cell was 9.6 kg/hr. The mean height, H, of the anolyte overflow levels in the hoods above the electrolyte overflow level in the cell was 45 mm, and the total suction set at a control point remote from the cell was 70 mm w.g. The specific gravity of the electrolyte was 1.18. Under these conditions electrolyte was drawn through the diaphragm and anolyte overflowed from the hoods through the outlet duct at a rate of 1.1 $m^3$/hr, a pH of 1.6, a temperature of 60° C., and with a nickel content of 61 g/l. At the same time electrolyte overflowed from the open cell through the overflow duct at a rate of 0.4 $m^3$/hr, a pH of 2.5, a temperature of 60° C., and with a nickel content of 60 g/l. There was no smell of chlorine in the atmosphere surrounding the cell.

EXAMPLE 2

In the same cell as used for Example 1, the graphite anodes were replaced by grid-type metal anodes of proprietary composition, design and construction. These anodes were advantageously thinner than the graphite anodes, thereby permitting more electrodes per cell and significantly greater nickel production per cell. The diaphragms and hoods were constructed of similar materials as those used with the graphite anodes, but were of somewhat different design and shape to suit the proprietary metal anodes. Characteristic operating and performance data for the use of these metal anodes are reported and compared in Table 1 to the corresponding data reported for graphite anodes in Example 1.

TABLE 1

Comparison of Operating and Performance Data for Graphite and Metal Anodes

| Anode Type | | Graphite | Metal |
|---|---|---|---|
| Number of anodes in cell | | 37 | 53 |
| Thickness of anodes, mm | | 40 | 4 |
| Distance between anode centres, mm | | 189 | 130 |
| Distance between electrodes, mm | | 75 | 63 |
| Cell current, KA | | 8.9 | 19.1 |
| Cathode current density, A/$m^2$ | | 172 | 200 |
| Cell voltage, V | | 3 | 3 |
| Current efficiency, % | | 98.5 | 98.5 |
| Nickel production, Kg/hr | | 9.6 | 20.6 |
| Mean hood overflow Height, H, mm | | 45 | 58 |
| Total Suction, S, mm w.g. | | 70 | 79 |
| Specific gravity of electrolyte | | 1.18 | 1.18 |
| Electrolyte feed to cell, | $m^3$/hr | 1.5 | 2.5 |
| | pH | 2.4 | 2.4 |
| | T ° C. | 62 | 60 |
| | g Ni/l | 67 | 73 |
| dissolved $Cl_2$, | mg/l | nil | nil |
| Anolyte overflow from Hood, | $m^3$/hr | 1.1 | 2.2 |
| | pH | 1.6 | 1.8 |
| | T ° C. | 60 | 65 |
| | g Ni/l | 61 | 65 |
| dissolved $Cl_2$, | mg/l | ~700 | ~700 |
| Catholyte overflow from cell, | $m^3$/hr | 0.4 | 0.3 |
| | pH | 2.5 | 2.8 |
| | T ° C. | 60 | 65 |
| | g Ni/l | 60 | 63 |
| dissolved $Cl_2$, | mg/l | <3 | <3 |

As with Example I there was no smell of chlorine above the cell of Example II.

EXAMPLE 3

In a cell similar to that described in Example 2, a series of 4 tests was made to determine the effect of increasing chlorine concentration in the catholyte on the chlorine concentration in the air above the cell. A constant suction of 59 mm w.g. was applied at the anode hoods while the value of H was increased from test to test by lowering the level of the electrolyte overflow weir. Chlorine concentrations in the catholyte were measured 3 cm below the electrolyte level at the centre of the cell and in the overflow from the cell and the chlorine concentration in the air about 20 cm above the centre of the cell was also determined.

The pertinent data are reported in Table 2.

Table 2

CHLORINE CONCENTRATIONS IN CATHOLYTE AND THE AIR ABOVE IT

| Test | 1 | 2 | 3 | 4 |
|---|---|---|---|---|
| Suction at Anode Hoods, mm w.g. | 59 | 59 | 59 | 59 |
| H, mm | 57 | 62 | 66 | 69 |
| Total Anolyte Overflow, $m^3$/hour | 2.3 | 2.0 | 1.7 | 1.5 |
| Chlorine in Catholyte, centre, mg/l | 4 | 7 | 14 | 26 |
| Chlorine in Catholyte, overflow mg/l | 4 | 5 | 11 | 16 |
| Chlorine in Air, centre, ppm | <0.3 | <0.3 | 0.4 | 0.6 |

Test 1 represents normal practice and while H was increased to unusually high values relative to the applied suction, to emphasize the effect of the change, what was even more remarkable than the dramatic increase in chlorine concentration in the catholyte with decreasing anolyte overflow was the fact that even with more than 6 times as much chlorine in solution as normal, the chlorine concentration in the air just above the cell was only 0.6 ppm, scarcely more than half the upper limit of 1 ppm that is a common suggested guideline throughout North America, if not elsewhere as well. While chlorine concentration in the catholyte of more than 25 mg/l is clearly tolerable, it is nevertheless recommended in the interest of caution that sufficient suction be applied relative to H that this concentration is held generally below about 5 mg/l and preferably about 3 mg/l or even less.

EXAMPLE 4

A similar cell to that described in Example 1 was set up for the electrowinning of cobalt from chloride-bearing electrolyte which was fed to the open cell at a rate of 1.7 $m^3$/hr, a pH of about 1.5, and a temperature of 62° C., with the following composition in g/l.

| Co | Cl | $So_4$ |
|---|---|---|
| 45.- | 54.- | 0.8 |

Current was supplied at 8.4KA, a cathode current density of 160 A/$m^2$, and a potential of 3.2 V. Current efficiency was 93% and cobalt production from the cell was 8.6 kg/hr. The height H of the anolyte overflow levels in the hoods above the catholyte overflow level varied in the range 37–50 mm, and the total suction applied at the set point was 60 mm w.g. The specific gravity of the anolyte was 1.08 and thus the driving force varied in the range 5–20 mm w.g. Under these conditions electrolyte was drawn through the diaphragms and anolyte overflowed from the hoods at a rate of 1.4 $m^3$/hr, a pH of 1.4, a temperature of 61° C., and with a cobalt content of 40 g/l. At the same time catholyte overflowed from the cell at a rate of 0.3 $m^3$/hr, a pH of 1.8, a temperature of 61° C., and with a cobalt content of 40 g/l. There was no smell of chlorine in the atmosphere surrounding the cell.

A feature of the present invention, that is significant with respect to the electrowinning of cobalt, is the anolyte pH, which should be kept below about 1.7. At higher pH cobaltic hydroxide precipitates and is highly undesirable because, if left unchecked, the diaphragm bag becomes filled with the precipitate which then penetrates the pores of the diaphragm itself and results in the evolution of chlorine on the outside of the diaphragm in the open cell, an intolerable situation.

The rise in pH of both the catholyte and the anolyte, above the pH of the electrolyte fed to the cell, is less the higher the feed rate of electrolyte, but depends on other factors as well. Thus it has been found that if electrolyte is fed to the bottom of the cell, rather than to the top and if catholyte overflow from the cell is drawn from the bottom of the cell rather than from the top then pH and concentration gradients can become established vertically in the cell and can lead to various undesirable effects, including non-uniform deposition of metal on the cathode, decreased cathodic current efficiency and precipitation of metal hydroxides. Such effects can be advantageously avoided by feeding electrolyte to the top of the cell and by drawing the overflow catholyte from nearer the top than the bottom of the cell.

What I claim is:

1. In a method for electrowinning metal from an aqueous chloride electrolyte in a cell open to the atmosphere around it and containing a multiplicity of alternating anodes and cathodes by electrolyzing the electrolyte thereby generating metal at the cathodes and catholyte around them, generating chlorine at the anodes and anolyte around them, and dissolving a portion of the chlorine in the anolyte, each anode being surrounded by an electrolyte-permeable diaphragm bag thereby providing a boundary between anolyte inside the bag and catholyte outside it, the improvement comprising, (i) securing each bag to an anode hood extending upwardly from below the surface of the electrolyte and enclosing a freeboard space above enclosed electrolyte surrounding the anode, said hood being equipped with an outlet therefrom above the top of the cell for overflow of anolyte, (ii) providing an outlet from the cell below the top thereof for overflow of catholyte, (iii) applying suction to the anode hoods to establish a level of anolyte above the level of catholyte and generate a first flow of electrolyte in the cell directed into the bags, upwardly inside the hoods and through the outlets therefrom as a multiplicity of anolyte overflows, thereby inhibiting back-diffusion of dissolved chlorine out of the bags into the catholyte and escape therefrom into the atmosphere around the cell, and to withdraw simultaneously chlorine from the freeboard space above the anode, and (iv) simultaneously feeding fresh electrolyte to the catholyte at a rate in excess of total anolyte overflow rate to generate a second flow of electrolyte in the cell directed through the outlet from the cell as catholyte overflow, thereby establishing a catholyte level in the cell, and dividing electrolyte flow in the cell into both anolyte and catholyte overflows, so that total anolyte overflow rate is adjusted to applied suction and differences in each diaphragm permeability, while at the same time electrolyte feed rate to the cell can be held constant for a constant cell current thereby advantageously effecting constant metal depletion from the electrolyte in the cell, as electrowinning proceeds.

2. Method according to claim 1 comprising applying suction to the anode hoods and withdrawing chlorine therefrom through the anolyte outlets, thereby also removing dissolved chlorine from the anolyte overflow.

3. Method according to claim 1 for recovery of nickel from the electrolyte comprising feeding nickel chloride-bearing electrolyte to the cell at a pH of less than about 3 and at a rate to maintain a pH in the catholyte of less than about 3.

4. Method according to claim 1 for recovery of cobalt from the electrolyte comprising feeding cobalt chloride-bearing electrolyte to the cell at a pH of less than about 2 and at a rate to maintain a pH in the catholyte of less than about 2 and a pH in the anolyte of less than about 1.7.

5. Method according to claim 1 in a multiplicity of similar cells, each with a similar number of anodes and cathodes and each depositing a similar amount of metal at the cathodes and generating a similar amount of chlorine at the anodes comprising, feeding electrolyte at a similar rate to each cell, said rate exceeding the total anolyte overflow rate from any one of the cells, thereby ensuring catholyte overflow from each cell.

* * * * *